United States Patent [19]

Hockenbery

[11] Patent Number: 4,848,195

[45] Date of Patent: Jul. 18, 1989

[54] SPANNER-WRENCH

[76] Inventor: Paul M. Hockenbery, 17605 Roger Dr., Germantown, Md. 20874

[21] Appl. No.: 590,372

[22] Filed: Mar. 16, 1984

[51] Int. Cl.[4] ..... B25B 13/02

[52] U.S. Cl. ..... 81/176.2; 81/176.15

[58] Field of Search ..... 81/90, 120, 119, 53 A, 81/176.1, 176.15, 176.2; 29/237, 280, 282

[56] References Cited

U.S. PATENT DOCUMENTS

| | | | |
|---|---|---|---|
| 154,445 | 8/1874 | Beecher . | |
| 455,606 | 7/1891 | Byrne . | |
| 648,135 | 4/1900 | Taggart | 81/119 |
| 1,040,982 | 10/1912 | Ingerham . | |
| 1,398,125 | 11/1921 | Carleton et al. . | |
| 1,425,845 | 8/1922 | Foster . | |
| 1,480,653 | 1/1924 | Barr . | |
| 1,774,050 | 8/1930 | Brown | 81/90 R |
| 1,882,462 | 7/1931 | Weber . | |
| 2,830,480 | 4/1958 | Brame . | |
| 3,299,496 | 1/1967 | Christensen | 29/237 |
| 3,768,345 | 10/1973 | Barnes . | |
| 4,345,361 | 8/1982 | Baumann | 29/237 |

*Primary Examiner*—Debra Meislin

*Attorney, Agent, or Firm*—Hoffman, Wasson, Fallow & Gitler

[57] ABSTRACT

A spanner wrench for tightening, or loosening, of pipe coupling assemblies, particularly in tight quarters. The wrench comprises a semi-cylindrical base, an arcuate aligner, and a handle that is secured to the base for applying rotational torque to the tool. The base has a plurality of notches defined in its leading edge so that the tool may be slipped into engagement, in an axial fashion, with the lugs on a pipe coupling. The arcuate aligner possesses a radial dimension of sufficient size that the combined height of the aligner and base is equal to the distance that the pipe coupling rises above the run of the pipes to be joined together.

1 Claim, 2 Drawing Sheets

SPANNER-WRENCH

BACKGROUND OF THE INVENTION

1. Field of Invention

This invention relates to spanner wrenches. More particularly, this invention relates to spanner wrenches for use in the construction industry for tightening or loosening pipe coupling assemblies.

2. Description of Prior Art

Spanner wrenches are utilized for applying torque to pipe coupling assemblies to effect a secure, leak-proof joint. The spanner wrench is applied to raised lugs which are circumferentially spaced about the assembly for engagement by the similarly spaced tooth-shaped members of the spanner wrench. Representative spanner wrenches are depicted in U.S. Pat. No. 1,882,462, Weber, and in U.S. Pat. No. 2,830,480, Brame.

The repeated application of spanner wrenches on the raised, radially projecting lugs of pipe coupling assemblies has caused problems in the past for the wrenches have slipped and damaged the raised lugs and/or have stripped the threads within the assembly. Furthermore, when working in tight quarters, such as occur when electrical lines are run through pipes that are positioned adjacent to walls, or ceilings, or within shallow raceways, the clearance needed to effectively apply torque to the pipe coupling assemblies has been lacking and the assemblies have not been made up properly.

Since spanner wrenches have proven ineffective in tight places, chain wrenches have been tried in lieu thereof. The chain wrenches, however, are cumbersome, for the free end of the chain must be passed radially about the lugs on the assembly and must then be pulled tightly about the pipe assembly joint to take up the slack in the chain. The stiffness of the chain makes secure engagement difficult to achieve. Thus, when one applies a torquing action to the pipe wrench, the wrench may slip, damage the lugs, and lead to an imperfect joint.

SUMMARY OF THE INVENTION

The problems of the prior art are overcome inasmuch as the present invention is constructed to slip axially onto th pipe coupling assembly and to allow torquing action to be applied thereto with a minimum of slippage. In addition, the semi-cylindrical base of the spanner wrench is much broader than known spanner wrenches and therefor transmits torque more effectively. Also an arcuate aligner is secured thereto so that the notches in the leading edge of the tool securely engage, and retain, the lugs spaced about the pipe coupling assembly. The resultant ease of tightening or loosening of the pipe coupling assembly, even in the tightest of spots within a minimum of radial clearance, causes minimal damage to the raised lugs of the joint while the spanner wrench is in operation.

BRIEF DESCRIPTION OF THE DRAWINGS

Referring now to the drawings, wherein similar parts are identified by the same reference throughout, a preferred embodiment of the instant invention is illustrated in FIGS. 1–4, and an alternative embodiment is illustrated in FIG. 5, wherein.

DESCRIPTION OF THE PREFERRED EMBODIMENT

Figure 1:
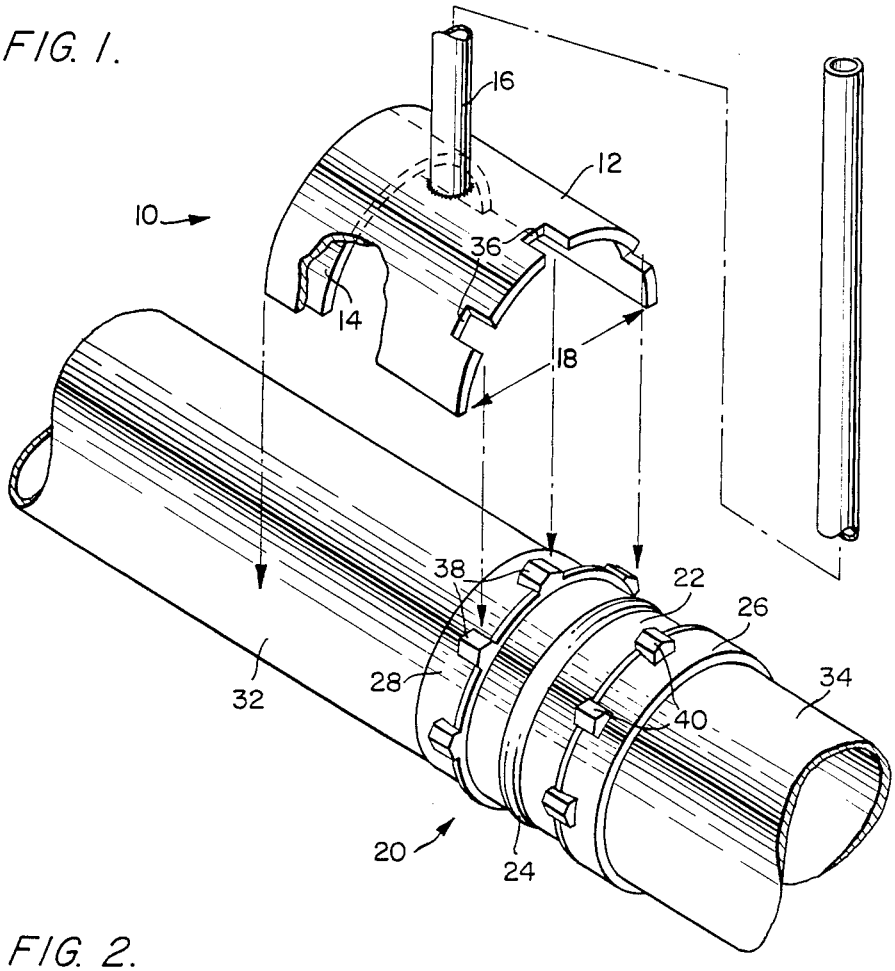
FIG. 1 is an exploded perspective of a preferred embodiment of the spanner wrench constructed in accordance with the principles of the invention, such view showing the tool prior to being engaged with the lugs on a pipe coupling.

Referring to the drawings, FIG. 1 illustrates a spanner wrench 10 embodying the invention. The spanner wrench comprises a semi-cylindrical base 12, an arcuate aligner 14, and a hollow handle 16 attached to the center of the base 12. The spanner wrench is constructed of a hardened steel.

Figure 2:
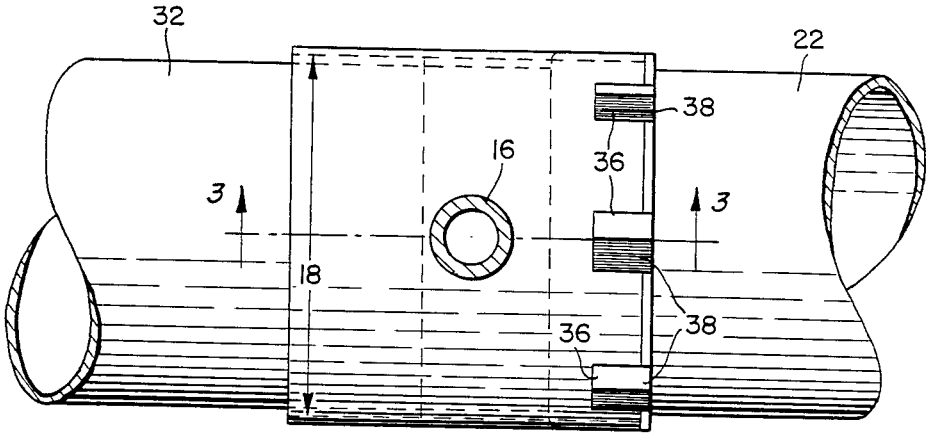
FIG. 2 is a top plan view of the spanner wrench secured to the lugs of the pipe coupling.

The base 12 of the spanner wrench, as shown in FIGS. 1 and 2, has an interior diameter 18 which is slightly greater than the exterior diameter of the pipe sections that receive the pipe coupling assembly 20 to permit the wrench to straddle the pipe sections.

Pipe coupling assembly 20, which is conventional in design, includes a short length of tubing 22 with an annular bead 24 formed at its midsection. Tubing 22 is threaded at its opposing ends, and a first, internally threaded coupling ring 26 is secured to one end of the tubing. A second coupling ring 28 is secured to the other end of the tubing. Each coupling ring has radially projecting lugs spaced circumferentially thereabout. A locking ring 30 (shown in FIG. 4) is positioned within each coupling ring.

One end of pipe section 32 is slipped into coupling ring 28, or vice versa, and the ring is tightened by spanner wrench 10 so that the locking ring bites into the exterior of the pipe section and forms a union therewith. The same procedure is followed with coupling ring 26 and adjacent pipe section 34. Assembly 20 thus joins together adjacent sections of pipe, or conduit. One manufacturer of this type of pipe coupling assembly is the Thomas & Betts Company, Inc., of Raritan, N.J.

Rectangular notches 36 are formed in the leading edge of the base 12 of wrench 10. The notches are slightly greater in width than the lugs 38 formed on coupling ring 28, and are similarly slightly greater in width than the lugs 40 formed on coupling ring 26. The notches are also deep enough to allow the lugs 38, 40 to be securely seated therewithin.

Figure 3:
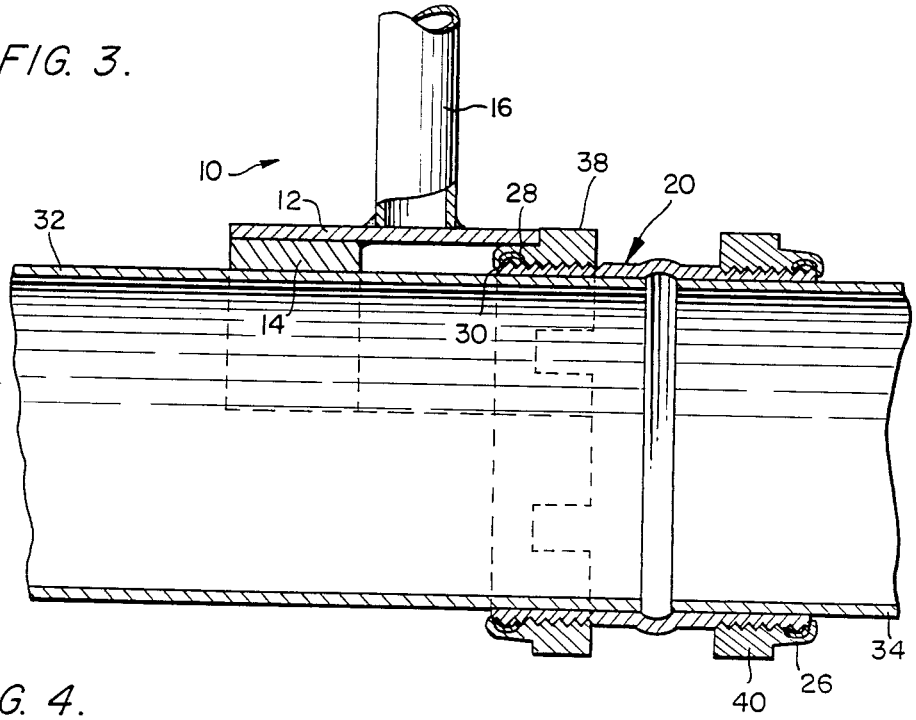
FIG. 3 is a vertical cross-sectional view through the spanner wrench and the pipe coupling, such view being taken along line 3—3 in FIG. 2 and in the direction indicated.

FIG. 3 shows that coupling 20 is greater in diameter than pipe sections 32, 34 to be joined together. Known spanner wrenches were not designed to compensate for this difference in diameter, and thus frequently performed unsatisfactorily, for the lugs on the coupling rings were approached at an angle of less than 90°. The manner in which aligner 14, which conforms in shape to the interior surface of base 12 of wrench 10, positions the tool relative to the coupling 20 in contradistinction to known wrenches is shown in FIG. 3. The aligner is secured to the base adjacent to the trailing edge thereof. The combined radial dimensions, or thicknesses, of aligner 14 and base 12, position the leading edge of the tool slightly above ring 28 but directly in the plane of the lugs of the coupling. The aligner 14 is approximately one-third the axial length of the coupling. Consequently, the tool 10 can be slid axially along the run of pipe section 32 until the tool is firmly engaged with the coupling ring. Then, the handle 16 is rotated radially to apply a torquing force to the coupling. The torquing force causes the locking ring 30 to bite into the exterior of the pipe section and secure the coupling ring in fixed position. The procedure is repeated for coupling ring 26 on pipe section 34 until a second locking ring 30 bites into the exterior of section 34, thereby forming a leak-proof joint.

Figure 4:
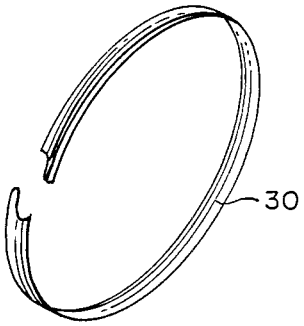
FIG. 4 is a perspective view of the locking ring utilized within the pipe coupling.

FIG. 4 shows the metal locking ring 30 used within coupling 20. The ring is formed of a resilient metallic material, and is positioned between the coupling ring and the pipe section upon which the coupling ring is seated. As the internal threads of the coupling ring are advanced along the external threads on the pipe section, the locking ring is forced inwardly and bites into the pipe section.

Figure 5:
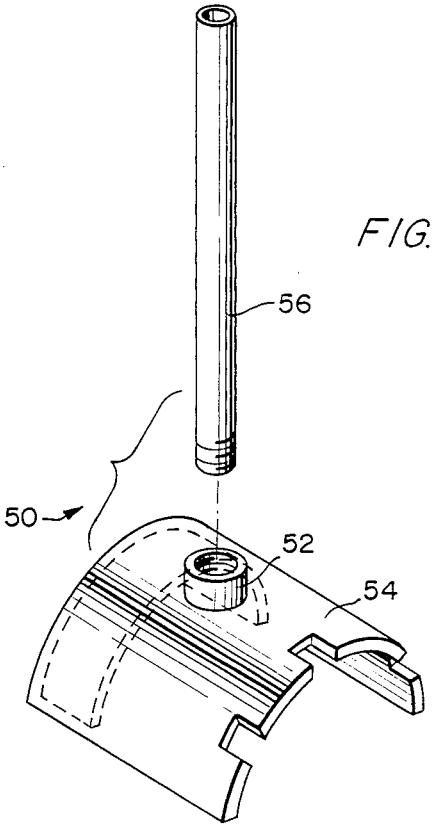
FIG. 5 is an exploded perspective view of an alternative embodiment of the spanner wrench.

FIG. 5 shows an alternative embodiment of the wrench. The preferred embodiment of wrench 10 shown in FIGS. 1-4 relies upon a handle 16 that is welded or otherwise permanently secured to base 12. The alternative embodiment of FIG. 5 illustrates a tool 50 that employs a collar 52 secured to the upper surface of base 54. The collar is internally threaded and receives the threaded lower end of handle 56. The handle 56 can be removed from the tool so that the tool may be readily transported. Alternatively, handles 56 of different length may be used to apply the desired torquing force. Furthermore, different bases with different dimensions may be employed so that a complete set of spanner wrenches can be formed by interchanging the handles and bases, thereby enabling the set to function satisfactorily with pipe coupling assemblies of different sizes and characteristics.

Numerous other modifications, revisions and alterations in the spanner wrench may occur to the artisan which fall within the spirit ans scope of this invention. Consequently, the appended claims should not be literally construed, but should be construed in a manner commensurate with the breadth of this invention.

I claim:

1. A spanner wrench consisting of:

a. a semi-cylindrical base having a leading edge and a trailing edge;

b. said leading edge having plurality of notches defined therein;

c. said notches being adapted to receive locking lugs therein;

d. said semi-cylindrical base having an inner and an outer surface;

e. an elongate handle secured to said outer surface of said base for applying a torquing force to said tool;

f. a semi-circular aligner secured to said inner surface of said base and extending forwardly from the tip of the trailing edge of said base;

g. said semi-cylindrical base having an axial and a radial dimension;

h. said semi-circular aligner having an axial and a radial dimension;

i. said radial dimension of said semi-circular aligner being approximately equal to said radial dimension of said semi-cylindrical base; and j. whereby said inner surface of said semi-circular aligner rests flush on a pipe section at the trailing edge of said semi-cylindrical base, wherein said semi-circular aligner elevates said base to a level whereby said notches located at the leading edge of said base align with coupling lugs of a pipe coupling in an axial direction.

* * * * *